US005853319A

United States Patent [19]

Meyer

[11] Patent Number: 5,853,319

[45] Date of Patent: Dec. 29, 1998

[54] GRINDING TOOL

[75] Inventor: Hans-Robert Meyer, Hollern-Twielenfleth, Germany

[73] Assignee: Ernst Winter & Sohn Diamantwerkzeuge GmbH & Co., Norderstedt, Germany

[21] Appl. No.: 713,020

[22] Filed: Sep. 12, 1996

[30] Foreign Application Priority Data

Sep. 13, 1995 [DE] Germany ..... 195 33 836.7

[51] Int. Cl.[6] ..... B24B 33/04

[52] U.S. Cl. ..... 451/548; 451/542; 451/544; 451/554

[58] Field of Search ..... 451/542, 544, 451/554; 51/297; 125/15

[56] References Cited

U.S. PATENT DOCUMENTS

| | | | |
|---|---|---|---|
| 1,422,200 | 7/1922 | Harris | 451/542 |
| 3,343,308 | 9/1967 | Fessel | 125/15 |
| 3,802,130 | 4/1974 | Lindenbeck | 451/544 |
| 4,196,547 | 4/1980 | Keske | 451/542 |
| 4,341,532 | 7/1982 | Oide | 451/544 |
| 4,565,034 | 1/1986 | Sekiya | 451/544 |

FOREIGN PATENT DOCUMENTS

| | | | |
|---|---|---|---|
| PS 715 807 | 12/1941 | German Dem. Rep. . | |
| GM 19 66 102 | 4/1967 | Germany . | |
| 3545308 | 6/1987 | Germany | 451/544 |
| 38 11 584 | 10/1989 | Germany . | |
| 362088575 | 4/1987 | Japan | 451/544 |
| 34076 | 2/1988 | Japan | 125/15 |
| 1085800 | 4/1984 | Russian Federation | 451/544 |
| 545 173 | 1/1974 | Switzerland . | |

*Primary Examiner*—Robert A. Rose
*Assistant Examiner*—George Nguyen
*Attorney, Agent, or Firm*—Mary E. Porter

[57] ABSTRACT

Grinding tool including a basic body symmetric with respect to rotation and a grinding layer deposited on the periphery of said grinding tool. The grinding layer being composed of the grinding grains, bonding agent and occasionally filler and/or wear-changing additives. The outer radius of the annular grinding layer or the extension in feeding direction perpendicular to the axis of the basic body is different, with the physical properties and/or the volume contents of the components of the layer are different in axial direction such that an adaptation to the different grinding load continuously in axial direction is achieved.

11 Claims, 2 Drawing Sheets

GRINDING TOOL

FIELD OF THE INVENTION

The invention refers to a grinding tool.

BACKGROUND OF THE INVENTION

A grinding tool having highly hard abrasive means, e.g. diamonds or cubic-crystalline boron nitride, usually is composed of a basic body symmetrical with respect to rotation and an annular grinding layer, The basic body which determines the static and dynamic strength of the grinding disc may for example consist of aluminum, synthetic resin with fillers, steel or ceramics. The grinding layer is composed of a grinding grain and a bonding agent. The grinding grains for example are diamonds or crystals of boron nitride which vary with respect to the grain sizes. Coarse grains allow a high chip removal per time unit, have a small wear at the grinding layer and cause a relatively high roughness. Fine grain sizes cause a small roughness, lead to a larger wear and allow only a small chip removal per time unit. The bonding agent which bonds the grinding grains together can be made of various types, e.g. synthetic resin bonds of phenol or polyimide resins, sintered metallic bonds, e.g. bronze bonds, steel bonds, ceramic bonds or hard metal bonds. Within the various types of bonding agents the individual bonds are adapted to the required grinding conditions by different compositions of the basic components of the grinding layer for example tin and copper in connection with bronze and also by different fillers, e.g. silicon carbide or corundum in connection with phenolic resin and by specific contents of the components thereof. Basically, metallic bonds are more resistive against wear than synthetic resin bonds. Metallic bonds grind harder and slower and generate more grinding heat than grinding discs with a resin bond. Besides, galvanic bonds are known.

Besides annular or cylindrical grinding surfaces, frequently grinding discs with a profiled grinding layer are used. Depending upon its shape or profile, the radial extension of the grinding layer changes across the axial direction of the basic body or in the feed direction, respectively. The profile and the dimension of the grinding layer above all depends upon the desired profile of the workpiece which is to be provided. It can be observed that specific areas of the grinding layer are subject to a higher wear than others. Exceptions are formed by workpieces having a pre-shaped profile which is characterized by a uniform size in feed direction of the grinding disc, A corresponding preshaping or pre-machining of the workpiece is relatively expensive and therefore not usual in practice. The stability under load of such grinding discs normally depends upon how long the individual zones of the grinding layer suffer the most load.

The object of the invention is to provide a grinding tool, with the grinding layer thereof having an increased durability despite non-uniform load in individual zones of the grinding layer by equalizing the wear.

SUMMARY OF THE INVENTION

In the grinding tool according to the invention the physical properties and/or the volume contents of the grinding layer constituents are continuously differential in the axial direction such that they are adapted to the grinding condition or load, respectively, in the axial direction of the workpiece. The zones of the grinding layer which are more stressed have a different composition and constitution of its components than zones which are less loaded. The composition and/or proportion of the components of the grinding layer, thus, is differentially and continuously adapted to the load in the axial direction.

With the invention it is considered that the wear per surface unit of the grinding layer essentially depends upon the fact, how long it engages the workpiece to be grinded or, respectively, upon the volume of the workpiece to be removed. With grinding tools having a profiled grinding layer the area of the grinding layer which has to remove the most volume engages the workpiece longest. This area, normally, is the most radially outwards located portion or, respectively, the portion most outwardly if looking in feeding direction.

The wear and behavior of a profiled grinding disc depends on different parameters. One refers to the concentration of the grinding grains. Others, which are discussed later, include grain sizes, the nature of the bonding agent, and filler and additives. These parameters are well-known.

The concentration indication defines a volume contents of diamonds or boron nitride in the grinding layer. The concentration is one of the most important factors of a diamond or boron nitride grinding disc, respectively. It highly influences the grinding forces, the grinding temperatures, the resulting roughness of the workpiece and the life of the tool. The concentration is to be adapted to the other parameters of the grinding tool, the grinding process and the conditions for machining. Normally, the concentration is indicated by carat per $cm^3$. In order to increase the life time of the grinding disc the concentration of the complete grinding layer could be increased proportionally. However, this results in an increase of the grinding forces and the grinding temperatures which occasionally lead to deviations of the sizes and the shape of the grinding layer influences the texture of the surface grinded, respectively. In accordance with an embodiment of the invention the concentration is increased in those zones of the grinding layer where a higher wear occurs while in the zones of the layers having a lower wear and load the concentration is even reduced in order to prevent the grinding forces and the grinding temperatures from increasing beyond a desired amount.

Through a corresponding distribution of the concentration in the axial direction of the grinding layer defending upon the radial distance the layer surface is from the axis of the disc, a uniform wear of the grinding layer can be achieved over the complete size of the portion to be removed. As a result an essentially longer tool life can be achieved. In ideal cases the complete grinding layer can be consumed without a re-machining of the layer.

A further parameter which influences the stability and the chip volume per time unit is the grain size. Coarse grain sizes result in a high chip removal per time unit, small wear and a large roughness. Fine grain sizes result in a small roughness, a higher wear and a smaller chip removal per time unit. According to the invention, the grain size of the grinding layer can be selected differently in the axial direction, e.g. the area there the grinding disc has to remove the largest volume of the workpiece may have a larger grain size whereas the grain size reduces in axial direction where there is a smaller or decreasing load, respectively. Since the maximum roughness of the workpiece is predetermined, the grain size at times will be limited.

The nature of the bond is important for the chip removal per time unit to be achieved. Synthetic resin bonds, e.g. including phenolic or polyimide resins, are soft and allow a cool and fast grinding, however, result in small grinding forces and an extended margin for adaptations. Sintered bronze bonds join to the synthetic resin bonds in the direction of higher bonding hardness. Steel and hard metal bonds have a still harder effect, Metallic bonded grinding discs, normally, grind harder, slower and generate more grinding heat than grinding discs having a synthetic resin bond. Ceramic bonds result in high chip removal per time unit and a high resistance against wear. They are capable of clearance grinding through their porosity and their self-sharpening effect and allow a satisfactory transport of cooling fluid into the zone of engagement.

For further adaptation to grinding problems other variations exist among the individual kinds of bonds.

It is known to add fillers and additives, respectively, to the grinding layers of the kind discussed above. Fillers and additives, respectively, have a lubricating effect, e.g. graphite. This reduces grinding forces and temperatures. However, in most cases the wear is increased. It is also known to use additives which influence the wear, essentially wear-reducing additives, e.g. cobalt. Additives which reduce the wear require a higher grinding force, result, however, lead to a reduction of wear. If for example in the zone of maximum load the resistance against wear is increased by such additives, it is also possible to obtain an approximately uniform wear through the complete profile of the grinding disc with at the same time sufficient chip removal per time unit.

In an embodiment of the invention it is suggested that the volume contents of the grinding grains and/or of the lubricating filler and/or the wear-reducing additives and/or of the composition of the basic components, the binding means and/or the grain size of the grinding grains is changed in response to the size of the radius of the outer surface of the layer such that the grinding disc has the largest resistance against wear at the largest radius. The change mentioned is made continuously, meaning that no abrupt change takes place between individual concentrations or distributions so that there is a smooth of steady change of alteration of the composition of the grinding layer in the axial direction. Preferably, it is adapted to the profile of the grinding layer or of the workpiece, respectively.

If the grinding surface has a linear extension the change may be also linearly. If, however, there is another profile desired, the change can have a progressive or degressive variation.

It is known to manufacture a grinding disc such that a ring of grinding means is generated. A mixture of grinding grains and powder-like bonding agent and occasionally lubricating and/or wear resistance-reducing materials are filled into a press mold having an annular molding cavity and afterwards pressed to an annulus. The inner boundary of the cavity can be defined by the basic body. After the annular parison has been made a reshaping has to take place if the grinding layer is to be provided with a desired profile. For the manufacture of the grinding disc according to the invention the above described process is used. This is carried out such that during the filling of the cavity, the volume contents and/or the grain size of the grinding grains and/or the contents of lubricating and/or wear changing additives and/or the composition of the basic components of the bonding agents is/are changed in dependence of the radial extension of the grinding profile changes with the height of the material filled in. During the pressing step the height or the thickness, respectively, of the material in the cavity is significantly reduced. The relative distribution of the concentration does not change, The molds for the manufacture of the grinding layer normally include a first mold portion confining a cylindrical cavity. The basic body is placed in the cavity, with its periphery defining a wall of the annular cavity formed between the basic body and the mold. A second mold portion is annular and serves for the pressing of the grinding layer material filled in. The filling step of the grinding material which is the focus of this invention, is such that the mold is rotated, with the annular cavity thereof moving along a first stationary supply means which supplies the mixture of the grinding layer material, in particular bonding agent and grinding grains. Proportioning means proportionate the mixture prior to being supplied to the cavity, with the amount of mixture selected in dependence of the time or also of the rotation of the mold. With the manufacture of a grinding disc according to the invention for example at least a further second stationary supply means is provided with an associated proportioning means. The supply means are supplied with a mixture of grinding grains, bonding agent and filler materials consisting of a predetermined, however, different proportion of mixture or of different condition for influencing the chip removal. For example, in order to achieve values for the upper and the higher concentration of the grinding grains in the resulting grinding layer it is necessary that the supply means providing the lower concentration material is supplied with a proportion of mixture which corresponds to the lowest value of the concentration of the grinding grains found in the resulting grinding layer. The other supply means is supplied with a mixture in a proportion such that an addition to the lowest concentration value corresponds to the upper concentration value. By a respective proportion of the mixtures fed into the cavity by the supply means the desired concentration value can be adjusted in response to the time effectively varying the concentration in the resulting grinding layer axially. It is also conceivable to provide more than two supply means supplied with a mixture having different concentration values for the grinding grains. The same goes for the adjustment of the other parameters determining the grinding and wear behaviour: grain sizes, composition of the bonding materials and contents of lubricating and/or wear-reducing additives.

With the invention a grinding tool is achieved which is adapted to the different applications, in that the layer contents influencing the wear is varied throughout the width or along the axis of the grinding disc. For example, reinforcement of the edges can be provided to obviate an increased load in this area.

With the invention already an improvement is achieved if the parameter influencing the grinding behaviour is changed in correspondence with the profile of the grinding disc through the width or axis, respectively, thereof. It is understood that also a change with respect to further parameters or a part thereof can be achieved additionally or alternatively. As to this, it is to be considered that a balance between the grain sizes and the hardness of the bonding agent has to be observed. The use of a grinding-inactive filler, e.g. cell or pore developer may be also adapted to the material of the workpiece.

BRIEF DESCRIPTION OF THE DRAWINGS

The invention is hereafter explained in more details along with the accompanying drawings, wherein FIG. 1 diagrammatically shows a cross section through a grinding tool according to the invention.

DETAILED DESCRIPTION OF THE INVENTION

Figure 1:
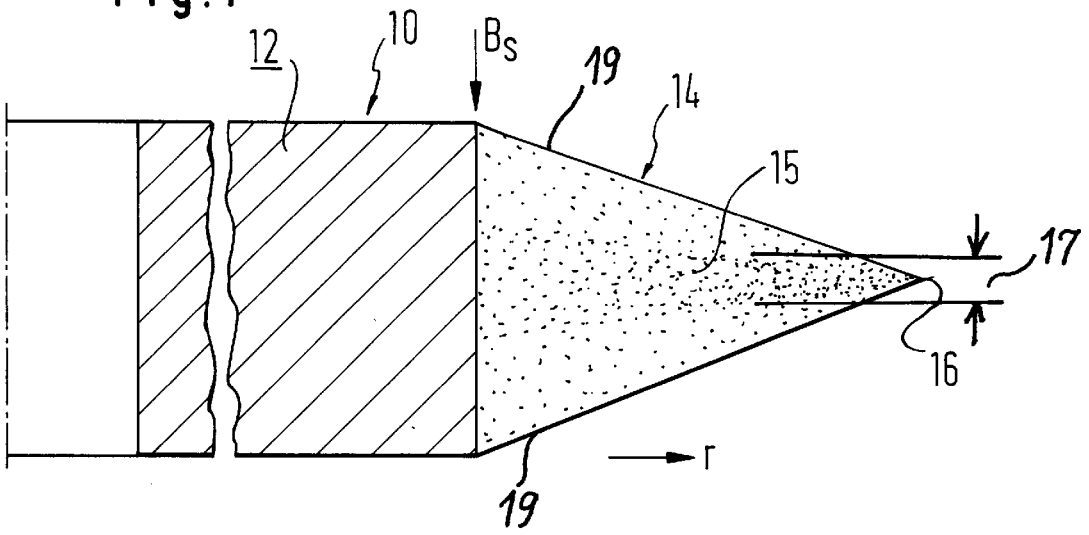

FIG. 1 shows a grinding disc 10 having a basic body 12 of suitable material, e.g. steel, aluminum, or plastics, e.g. a suitable thermo-setting material. A grinding layer 14 triangular in cross section is applied to the basic body. The grinding layer 14 is structured in a conventional manner but may have a variety of profiles. The distribution, thus, corresponds to a linear course from the apex of the layer to the front surfaces of the body. In the case of a profile having a different shape, the concentration of grain in the axial direction will be different. Grain concentration is selected such that the wear behavior of layer 14 is adapted to the quantity of material to be removed from the workpiece. The wear behavior depends on the amount of time the different portions of layer 14 are in engagement with the workpiece, relative to the total amount of time needed to grind the workpiece. Wear behavior also depends on the quantity of material removed by the different portions of layer 14, relative to the total quantity of material removed during grinding.

In the tools of the invention, the benefit of varying grain concentration exists in addition to, and is independent of, the benefits achieved by selection of grain size or bonding agent. Both grain size and bonding agent type have an influence on the grinding and wear performance of the grinding layer. Changing the grain size or the type of bonding agent in portions of the grinding layer can adapt the grinding layer to accommodate a varying load across the width of the grinding disc 10. The same adaptation to varying load can be achieved by varying the selection of grinding-inactive additives, such as pore developers, lubrication materials and other additives affecting wear behavior.

It is understood that the invention is also valid for multi-profiled discs having for example two or more annular grinding layers each corresponding to that of FIG. 1.

Figure 3:
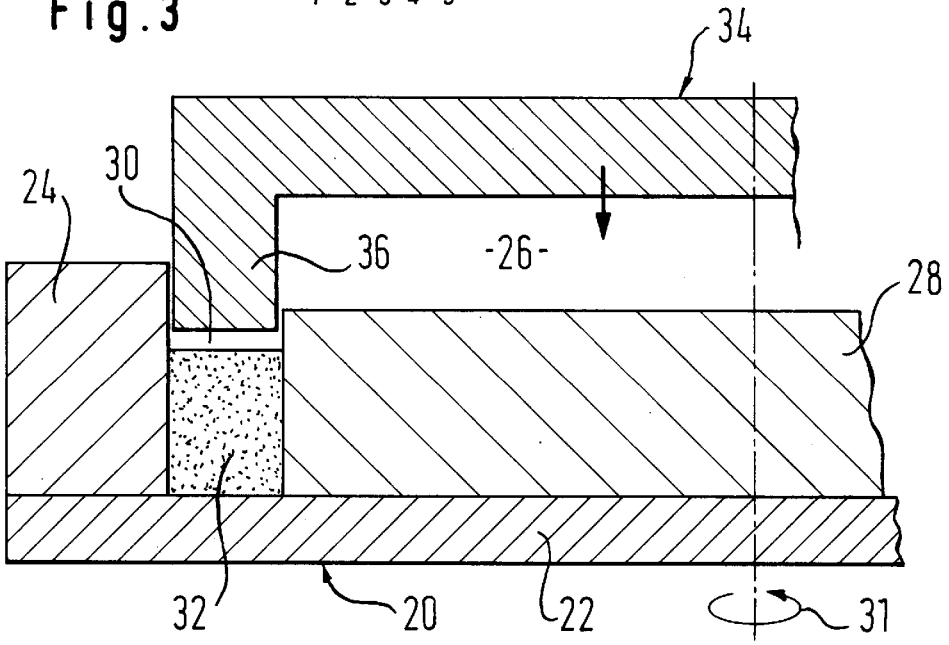
FIG. 3 diagrammatically shows an apparatus for the manufacture of a grinding layer of the tool of FIG. 1 and FIG. 4 diagrammatically shows a plain top view of the cavity of the apparatus of FIG. 3.

In FIG. 3 an apparatus for the manufacture of the grinding layer is extremely diagrammatically shown. A first molding portion 20 includes a table-like portion 22 and an annular portion 24 confining a cylindrical cavity 26. By placing a parison of a cylindrical basic body 28 in the cavity 26 an annular cylindrical cavity 30 is formed. It is filled with a mixture 32 of grinding grains, powder-like bonding agent and further additives, e.g. grinding-inactive filler materials. The filling of the mixture 32 takes place during rotation of molding portion 20 as indicated by arrow 32. A second molding portion 34 includes an annular cylindrical molding portion 36 which can be fittingly introduced into cavity 30. By means of the moulding portion 36 the mixture 32 in cavity 30 can be pressed to an annulus having approximately the third of the original height. Thereafter the mixture is heated. Thereby an annular grinding layer is achieved which is firmly bonded to the basic body 28. Thereafter, basic body 28 is machined down to the width of the grinding layer. Furthermore, the grinding layer is provided with a desired profile, for example as shown in FIG. 1.

Figure 2:
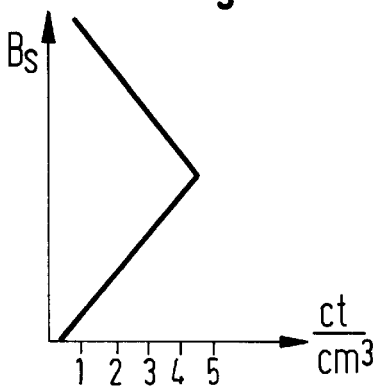
FIG. 2 shows a diagram for the distribution of the grinding grains in the grinding layer of the tool of FIG. 1.
Figure 4:
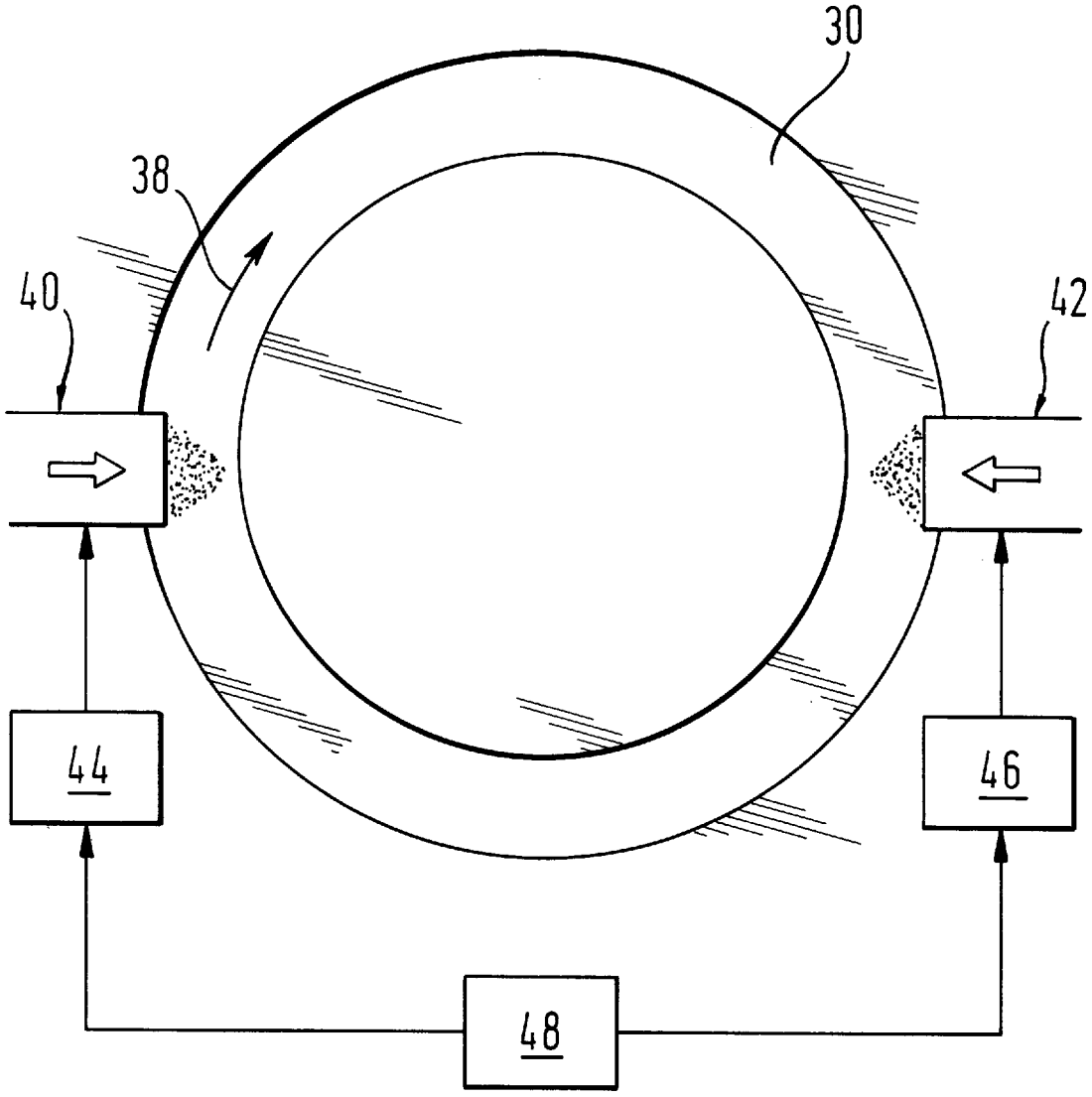

FIG. 4 shows the cavity 30 of FIG. 3, with the rotation of cavity 30 indicated by arrow 38. First supply means 40 diagrammatically illustrated is located above cavity 30. A second supply means 42 is located diametrically opposite to supply means 40 also above cavity 30. A mixture of grinding grains and powder-like bonding agent in a desired proportion is supplied to the supply means 40, 42, with for example the concentration of the grinding grains of the mixture supplied to supply means 40 being 0,3 ct/cm$^3$, whereas the concentration of the grinding grains of the mixture supplied to supply means 42 is 4,1 ct/cm$^3$ or more. The supply means 40, 42 are associated with proportioning means 44, 46 which are controlled by a processor 48. Through the proportioning means 44, 46 the processor 48 controls the amount which is delivered by the supply means 40, 42 per time unit. In this way the concentration of the grinding grains can be varied through the height of the material filled in (see FIG. 3) as desired. The concentration may have the course indicated in FIGS. 1 and 2. This means that in the most lower and most upper layer a minimum concentration of the grinding grains is prevailing while it is maximum in the center.

I claim:

1. A grinding tool for the grinding of profiles on workpieces comprising a basic body symmetrical with respect to an axis of rotation of the grinding tool, the basic body having a circular periphery, and an annular grinding layer deposited on the periphery of the basic body, the grinding layer being composed of a mixture of components comprising grinding grains and bonding agent, the components of the grinding layer being present in variable volume percent concentrations within axial layers, the axial layers having different radial dimensions, wherein the concentrations of components within the axial layers are effective to equalize wear rates among the axial layers when the grinding layer is subjected to variable axial grinding loads during profile grinding.

2. The grinding tool of claim 1, wherein the concentration of the grinding grains in axial direction is different.

3. The grinding tool of claim 1 wherein the grain size of the grinding grains in axial direction is different.

4. The grinding tool according to claim 1, wherein the composition of the components of the bonding agent is different in axial direction.

5. The grinding tool of claim 1, wherein the concentration of the filler materials having a lubricating effect is different in axial direction.

6. The grinding tool of claim 1, wherein the concentration of additives influencing the wear is different in axial direction.

7. The grinding tool of claim 1, wherein the radial dimensions of the axial layers include a maximum radial dimension and a minimum radial dimension, and the volume percent concentration of grinding grains in the grinding layer is at a maximum in the axial layer having the maximum radial dimension and at a minimum in the axial layer having the minimum radial dimension.

8. The grinding tool of claim 1, wherein the volume percent concentrations of the components within the axial layers of the grinding layer changes by step.

9. The grinding tool of claim 1, wherein the volume percent concentrations of the grinding grains within the axial layers changes continuously in axial direction.

10. The grinding tool of claim 1, wherein the grain size within an axial layer is directly proportional to the radial dimension of the axial layer.

11. The grinding tool of claim 1, wherein the mixture of components further comprises at least one component selected from the group consisting of grinding grains having variable grain sizes, lubricating fillers and wear-reducing additives, and combinations thereof.

* * * * *